United States Patent [19]

Masaki

[11] 4,330,780

[45] May 18, 1982

[54] RADIO PAGING RECEIVER HAVING PRE-RECORDED VOICE MESSAGES WHICH ARE SELECTED BY ADDRESS CODES AND READ OUT RESPONSIVE TO A SUFFIX CODE

[75] Inventor: Masaru Masaki, Tokyo, Japan

[73] Assignee: Nippon Electric Co., Ltd., Tokyo, Japan

[21] Appl. No.: 109,307

[22] Filed: Jan. 3, 1980

[30] Foreign Application Priority Data

Jan. 10, 1979 [JP] Japan ..... 54-2462

[51] Int. Cl.[3] ..... G08B 5/22

[52] U.S. Cl. ..... 340/825.44; 360/12; 455/31; 455/38

[58] Field of Search ..... 340/311, 312, 694, 692, 340/539, 167 R, 171 R, 23, 24; 360/5, 12; 455/31, 70, 38, 140, 151, 156, 227; 179/100.1 A, 100.1 C, 100.1 VC, 2 EC, 41 A

[56] References Cited

U.S. PATENT DOCUMENTS

| | | | |
|---|---|---|---|
| 3,729,680 | 4/1973 | McDonald | 340/311 |
| 3,755,818 | 8/1973 | Greenspan | 360/12 |
| 3,858,195 | 12/1974 | Gregg et al. | 340/311 |
| 4,010,461 | 3/1977 | Stololski | 340/311 |
| 4,095,215 | 6/1978 | Mortimer | 340/311 |
| 4,135,143 | 1/1979 | Argentieri et al. | 360/12 |
| 4,160,240 | 7/1979 | Partipilo | 340/311 |
| 4,190,819 | 2/1980 | Burgyan | 340/23 |
| 4,263,480 | 4/1981 | Levine | 179/2 EC |

FOREIGN PATENT DOCUMENTS 51-33904 3/1976 Japan .

OTHER PUBLICATIONS

*Harris Semiconductor*, "HC-55516/55532", Jul. 1977.
*Harris Semiconductor*, "HC 55516/32 CVSD", Aug. 1977.
*Motorola Semiconductors*, "XC 3417, XC 3418".
*Motorola*, "Metro Pageboy A03TEC Series", 1974.
*NEC Radio Pager*, Type PR-150D2-1A.

*Primary Examiner*—James J. Groody
*Attorney, Agent, or Firm*—Laff, Whitesel, Conte & Saret

[57] ABSTRACT

A radio paging receiver operates upon receipt of a predetermined, sequential paging signal having at least first and second code signals. The receiver receives and decodes the first predetermined code signal to produce a first decoded signal indicating the nature of a desired page. A second decoded signal is produced when the second predetermined code signal is decoded, which must occur within a predetermined time period after the first predetermined code signal is decoded. Responsive to the first decoded signal, an alert signal generator sounds a paging alert tone. A predetermined number of digitized voice signals, representing various prerecorded vocal comments, are prestored in a memory in the receiver. One of the digitized voice signals, stored in the memory is selected in response to the first and second decoded signals and read-out thereby playing back as sound the digitized voice signal of the selected recoded vocal comments.

11 Claims, 3 Drawing Figures

RADIO PAGING RECEIVER HAVING PRE-RECORDED VOICE MESSAGES WHICH ARE SELECTED BY ADDRESS CODES AND READ OUT RESPONSIVE TO A SUFFIX CODE

This invention relates to a radio paging receiver and more particularly to such a receiver having means for giving a spoken message.

A conventional radio paging receiver, such as those disclosed in the U.S. Pat. Nos. 3,670,242 and 3,882,466, has a single alert tone (for example, a continuous tone or a intermittent tone) corresponding to a single caller's number. Another conventional radio paging receiver such as the "METRO-PAGEBOY" marketed by Motorola Inc., or "Digital Pager", Type PR-150-D2-1A marketed by Nippon Electric Co., Ltd., has two distinct alert tones corresponding to two caller's numbers or messages. It is difficult or impracticable for the user of these receivers to remember all of those caller's numbers and/or messages.

A still another conventional radio paging receiver, such as those disclosed in the Japanese Published Patent Application No. 51-33904, includes a display means for displaying numeral information such as the caller's number, in addition to a loud speaker which is an annunciator. In the receiver, the capacity of displaying a long message or information results in an increase in the size of the receiver and in the number of display elements. In this connection, since the transmitter of a base station must transmit long messages for the plural radio paging receivers following the paging tones, respectively, a long time is required to access all the radio paging receivers. In addition, the base station is complicated in construction and operation. Furthermore, it is practically difficult to change the content of the messages to fit the user's requirement.

An object of this invention is to provide a radio selective paging receiver which eliminates the above-described drawbacks.

According to the invention, a radio paging receiver operates upon receipt of a predetermined, sequential paging signal having at least first and second predetermined code signals. The receiver receives transmitted signals and decodes the first predetermined code signal for producing a first decoded signal indicating the nature of a desired page. A second decoded signal is produced when the second predetermined code signal is decoded, within a predetermined time period after the first predetermined code signal is decoded. Responsive to the first decoded signal, an alert signal generator sounds a paging alert tone. A predetermined number of digitized voice signals, representing various prerecorded vocal comments, are prestored in a memory in the receiver. One of the digitized voice signals, stored in the memory is selected in response to the first and second decoded signals and read-out thereby playing back as sound the digitized voice signal of the selected recoded vocal comments.

Figure 1:
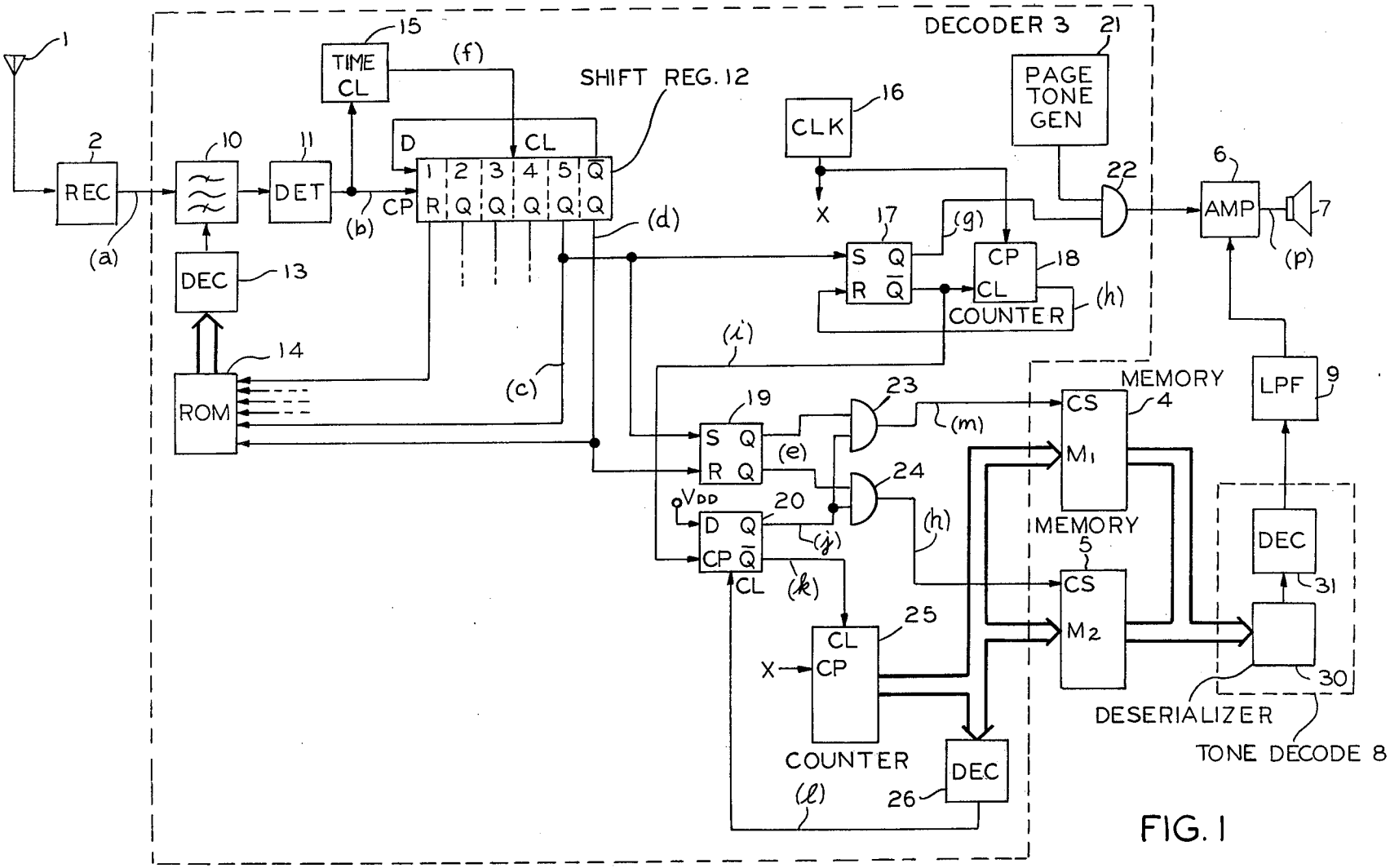
Figure 2:
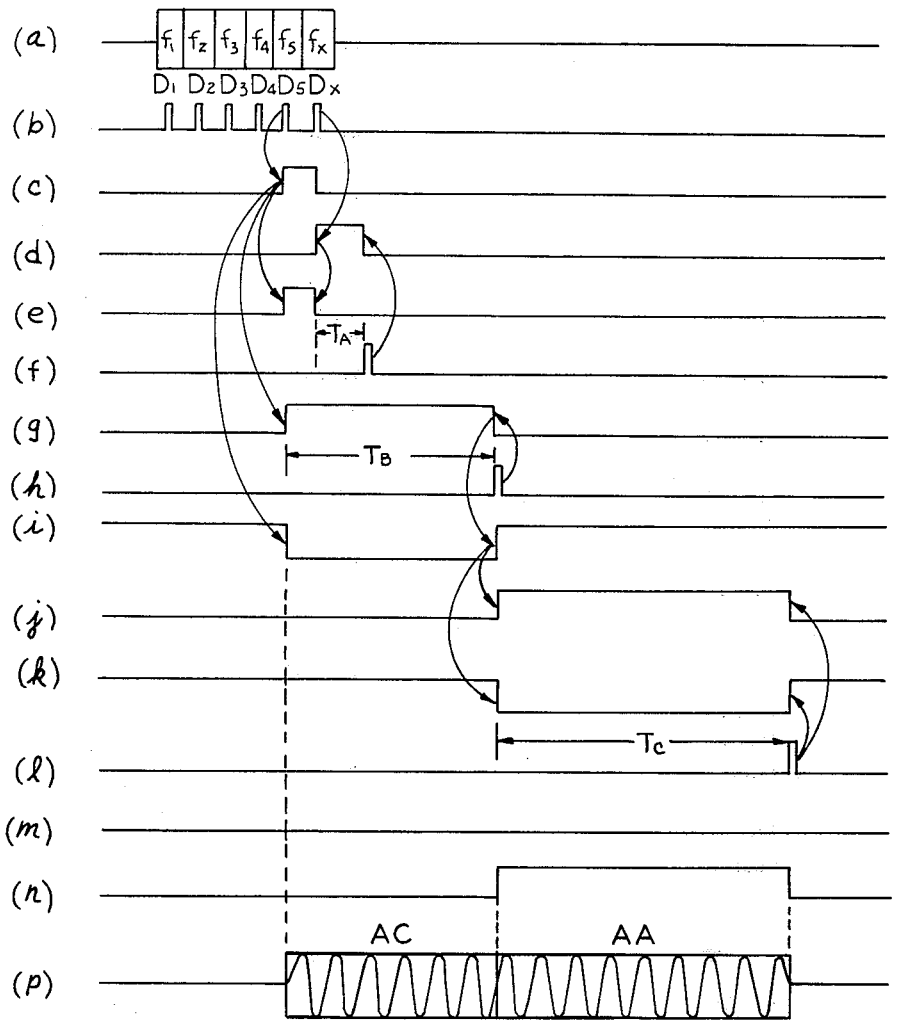
Figure 3:
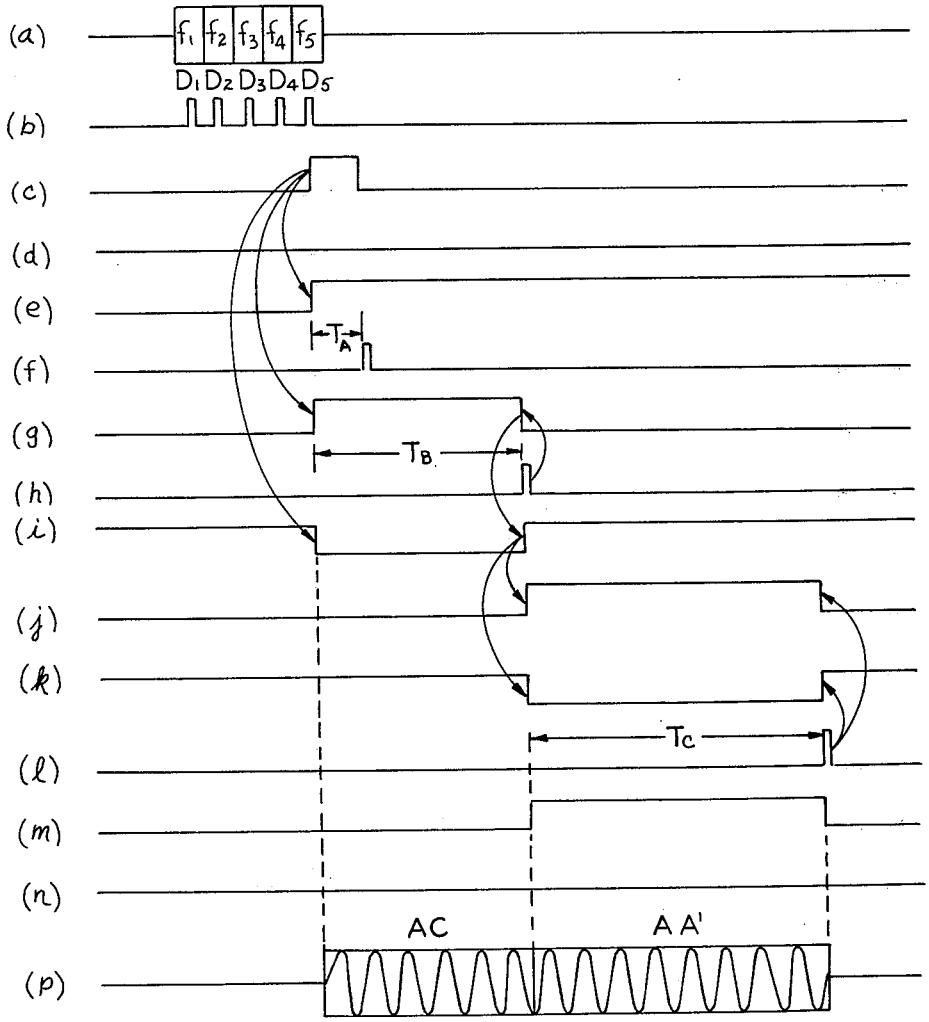

The invention will now be described in detail with reference to the accompanying drawings:

FIG. 1 shows one embodiment of a radio paging receiver according to the invention, and FIG. 2(*a*) through (*p*) and FIG. 3(*a*) through (*p*) show, by way of example, wave forms occurring at respective points in FIG. 1, assuming that the tone $f_x$ is received in FIG. 2 and not received in FIG. 3.

Referring to FIG. 1, the radio paging receiver is composed of an antenna 1, a receiving portion 2, a decoding circuit 3, memories (for example, Programmable Read Only Memories) 4 and 5, a tone amplifier 6, a loud speaker 7, a tone decoding circuit 8 and a low pass filter 9. The decoding circuit 3 comprises a frequency variable filter 10, a detector 11, a shift register 12, decoders 13 and 26, a ROM 14 for setting the paging number (Read Only Memory such as μPD 406 marketed by Nippon Electric Co., Ltd.) a timing circuit 15 (See U.S. Pat. No. 4,087,627), a clock generator 16, SR flip-flops 17 and 19, counters 18 and 25, a D-type flip-flop 20, a paging tone generator 21 and AND gates 22 through 24. The tone decoding circuit 8 comprises a deserializer 30 and a decoder 31.

The operation of the circuit in FIG. 1 will now be described with reference to FIGS. 2 and 3.

First, a description will be made for the circuit operation when tones of six waveforms $f_1$ to $f_5$ and $f_x$ (FIG. 2(*a*)) are received. As will become more apparent, signals $f_1$–$f_5$ select a recorded voice message and signal $f_x$ is a suffix which commands a read out of the selected message. The tone signals shown in FIG. 2(*a*) are received through the antenna 1 by the receiver 2. Upon demodulation thereby, they are fed to the decoding circuit 3.

When a first tone $f_1$ is received by the frequency variable filter 10 in the decoding circuit 3, the detector 11 produces a first detection pulse $D_1$, as shown in FIG. 2(*b*). This pulse then is fed to the shift register 12. The contents of ROM 14 are read out, stage by stage, responsive to the outputs of the 6-stage shift register 12, and are decoded by the decoder 13 so that the frequency variable filter 10 changes its center frequency in order to pass a second tone $f_2$. Then, after receiving the second tone $f_2$ shown in FIG. 2(*a*), a second detection pulse $D_2$ shown in FIG. 2(*b*) is fed to the shift register 12, the contents of which are shifted. The contents of ROM 14 are again read out, stage by stage, responsive to the outputs of shift register 12. The read out signals are decoded by the decoder 13 so that the center frequency of the filter 10 is changed to permit a third tone $f_3$ to be passed. In like manner, each of the further tones, from the 3rd to the 6th, is detected.

When the 5th detection pulse $D_5$ is fed to the shift register 12, the 5th stage output is present as shown in FIG. 2(*c*). Hence, the SR flip-flop circuits 17 and 19 are set as indicated at FIG. 2(*g*) and (*e*), respectively. When the 6th detection pulse $D_x$ is fed to the shift register 12, the 6th stage output is present as shown in FIG. 2(*d*), resetting the flip-flop 19.

If the 6th tone is detected and the following tone is not received during a predetermined length of time $T_A$, which is greater than the width of the tone signal, the shift register 12 is reset by the output (FIG. 2(*f*)) of the timer 15. The flip-flop 17 is reset by a reset signal (FIG. 2(*h*)) after the lapse of a time period, as predetermined by the counter 18. Therefore, the flip-flop 17 produces a pulse as shown in FIG. 2(*g*), activating the AND gate 22 to apply the output of the paging tone generator 21 through the amplifier 6. Thus, the speaker 7 produces a paging alert tone indicating the nature of a desired page, such as AC shown in FIG. 2(*p*), when the five tones $f_1$ to $f_5$ are detected.

The D-type flip-flop 20 is activated by a pulse shown in FIG. 2(*i*), and produces pulses shown in FIG. 2(*j*) and (*k*). Upon actuation of the AND gates 23 and 24 and counter 25 by these outputs, the outputs of the AND gates 23 and 24 are present as (*m*) and (*n*) in FIG. 2, respectively, selecting the memory 5. This memory stores a voice message in digital form, which corresponds with the 6th tone. An address signal is produced from the parallel outputs of the counter 25, and the contents of the memory 5 are read out in sequence by the output X of the clock generator 16, which contents are supplied from memory 5 to the tone decoding circuit 8. In this circuit 8, digital signals from the memory 5 are converted into analogue waveforms, and fed through the low pass filter 9 to the amplifier 6. The speaker 7 thus sounds the predetermined voice message, in correspondence with the 6th tone after having sounded the paging alert tone AC, as shown in AA of FIG. 2(*p*), for example, "Dial 501, please!".

The decoder 26 decodes the contents of the address. As shown in FIGS. 2(*f*) and 2(*k*), the flip-flop 20 is cleared after the lapse of time period, $T_c$.

Next to be described is the operation when tones of the five tones $f_1$ to $f_5$ (shown in FIG. 3(*a*)) are received. Detection of the tones $f_1$ to $f_5$ is effected in a manner similar to that described previously. When the shift register 12 receives a 5th input detection pulse $D_5$, as shown in FIG. 3(*b*), its 5th stage output is present as FIG. 3(*c*). The flip-flop circuits 19 and 17 are respectively set as shown in (*g*) and (*e*) of FIG. 3. Because there is no 6th tone $f_x$, the timer 15 as shown in FIG. 3(*f*) lowers the 5th stage output of the shift register 12 after the lapse of predetermined time period $T_A$ measured from the 5th detection pulse, as shown in FIG. 3(*c*). The flip-flop 19, due to (*d*) being of a low level as shown in FIG. 3, is not reset, thereby maintaining a high level as shown in FIG. 3(*d*).

The flip-flop 17 is reset by a reset signal (FIG. 3(*h*)), after the lapse of time period $T_B$, as predetermined by the counter 18. Hence, the flip-flop 17 produces a pulse shown in FIG. 3(*g*), activating the AND gate 22. The output of the paging tone generator 21 is amplified by the amplifier 6. The speaker 7 thus sounds a paging alert tone as shown in AC of FIG. 3(*p*) when the five tones $f_1$ to $f_5$ are detected.

The D-type flip-flop 20 is actuated by a pulse shown in FIG. 3(*i*), and produces the pulses in FIG. 3(*j*) and (*k*). As these outputs actuate the AND gates 23 and 24 and counter 25. The outputs of the AND gates 23 and 24 are presented, respectively, as (*m*) and (*n*) signals in FIG. 3, thereby selecting the memory 4. An address signal is produced from the parallel output of the counter 25. The contents of the memory 4 are read out in sequence responsive to the output X of the clock generator 16, which contents are supplied to the tone decoding circuit 8. They are fed through the low pass filter 9 to the amplifier 6. The speaker 7 thus sounds a message voice after having sounded the paging alert tone AC, as shown in AA′ of FIG. 3(*p*), in correspondence with the 5th tone, for example "Come back to office immediately".

As apparent from the foregoing, it will be appreciated that the paging receiver of the invention makes it possible to detect whether the 6th tone $f_x$ exists or not, to read out accordingly the contents of the memories 4 and 5 in response to the 5th tone detection pulse and the 5th and 6th tone detection pulses, respectively, and to let the user of the receiver know them. Further, although the invention has so far been described as employing tone signals, it may also use digital paging signals by incorporating a decoding section as in the above cited "Digital Pager". It is noted for reference that as a tone decoding circuit 8, ΔM decoding circuit (such as Models MC3417 and MC3418 marketed by Motorola, or Models HC-55526 and HC-55532 marketed by Harris Semiconductors, Inc.) may be used.

To sum up, the present invention comprises memories which store predetermined message or information voice signals in digital format. Upon receiving selective signals (comprising the 1st to 5th tones, or a paging signal), the speaker sounds a paging alert tone and also sounds the digitized voice signal stored in the memories, in response to the presence or absence of an additional signal (or the 6th tone) so that the user of the receiver may understand directly the contents of the signals without the necessity of previously memorizing what the contents each are in correspondence with any message. In addition, the user can readily change the content of the messages by replacing the memories.

What is claimed is:

1. A radio paging receiver comprising decoding means responsive to the receipt of successive radio paging signals, at least some of which include a suffix signal for producing a decoded message signal indicating the nature of a desired page; means responsive to one decoded message for sounding an alert tone; memory means for storing a predetermined number of digitalized voice signals representing various pre-recorded vocal comments; means responsive to another decoded message signal for selecting a particular one of said digitalized voice signals stored in said memory means; and means jointly responsive to said selecting means and to a suffix signal received within a predetermined time period after said selection of said one stored voice signals for reading out of said memory means a selected stored digitalized voice signal; and means responsive to a decoded message for both sounding said alert tone and playing back a pre-recorded comment responsive to a read out of a stored digitalized message.

2. A radio paging receiver operated in response to a predetermined sequential paging signal having at least first and second predetermined code signals, said receiver comprising: receiver means for receiving transmitted signals; decoding means coupled to said receiver means for producing a first decoded signal indicating the nature of a desired page in response to said first predetermined code signal, and for producing a second decoded signal when said second predetermined code signal is decoded within a predetermined time period after said first predetermined code signal is decoded; alert means responsive to said first decoded signal for sounding a paging alert tone; memory means for storing a predetermined number of digitized voice signals representing various pre-recorded vocal comments; selecting means for selecting one of said digitized voice signals stored in said memory means in response to said first and second decoded signals; read-out means responsive to said selecting means for reading out of said memory means the selected stored digitized voice signal, thereby playing back the sounds of the selected recoded vocal comments, said read-out means including address generating means responsive to the output of said selecting means for generating memory address signals, means responsive to said address signals for causing the read-out of said stored digitized voice signal; and means coupled to said decoding means and said selecting means for playing back said sounds of the selected recoded vocal comments after having sounded said paging alert tone.

3. A radio paging receiver operated in response to a predetermined sequential paging signal having at least first and second predetermined code signals, said receiver comprising: receiver means for receiving transmitted signals; decoding means coupled to said receiver means for producing a first decoded signal indicating the nature of a desired page in response to said first predetermined code signal, and for producing a second decoded signal when said second predetermined code signal is decoded within a predetermined time period after said first predetermined code signal is decoded; alert means responsive to said first decoded signal for sounding a paging alert tone; memory means for storing a predetermined number of digitized voice signals representing various pre-recoded vocal comments; selecting means for selecting one of said digitized voice signals stored in said memory means in response to said first and second decoded signals; read-out means responsive to said selecting means for reading out of said memory means the selected stored digitized voice signal, thereby playing back the sounds of the selected recoded vocal comments; and means coupled to said decoding means and said selecting means for playing back said sounds of the selected recoded vocal comments after having sounded said paging alert tone.

4. A radio paging receiver as claimed in either claim 2 or 3 wherein said memory means contains replaceable and changeable digitized messages, whereby said prerecoded voice comments may be changed.

5. A radio paging receiver comprising decoding means responsive to the receipt of successive radio paging signals, wherein said radio paging signals comprise a succession of pulse signals and said decoding means comprises a shift register device responsive to said succession of pulse signals, at least some of said paging signals including a suffix signal for producing a decoded message signal indicating the nature of a desired page; means responsive to one decoded message for sounding an alert tone; memory means for storing a predetermined number of digitalized voice signals representing various pre-recorded vocal comments; means responsive to another decoded message signal for selecting a particular one of said digitalized voice signals stored in said memory means; means jointly responsive to said selecting means and to a suffix signal received within a predetermined time period after said selection of said one stored voice signals for reading out of said memory means a selected stored digitalized voice signal; and means responsive to a decoded message for both sounding said alert tone and playing back a prerecorded comment responsive to a read out of a stored digitalized message.

6. The receiver of claim 5 wherein said succession of paging signals includes said suffix which is a particular signal which indicates that a vocal comment is required, and said decoding means includes address generating means generated responsive to said particular signal for generating a memory address corresponding to the desired pre-recorded vocal comment, and means responsive to said address generating means for causing the read out of said stored digitalized voice signal.

7. The receiver of claim 6 wherein said one decoded message includes an absence of said particular suffix signal.

8. A radio paging receiver comprising decoding means responsive to the receipt of successive radio paging signals for producing a decoded message signal indicating the nature of a desired page; means responsive to one decoded message for sounding an alert tone; memory means for storing a predetermined number of digitalized voice signals representing various prerecorded vocal comments; selecting means responsive to another decoded message signal for selecting a particular one of said digitalized voice signals stored in said memory means; means responsive to the output said selecting means for reading out of said memory means a selected stored digitalized voice signal and thereby playing back the sounds of the selected recorded vocal comments; and means coupled to said decoding means and said selecting means for playing back said sounds of the selected recorded vocal comments after having sounded said paging alert tone.

9. A radio paging receiver as claimed in claim 8 wherein said memory means contains replaceable and changeable digitized messages, whereby said prerecoded voice comments may be changed.

10. A radio paging receiver comprising decoding means responsive to the receipt of at least one radio paging signal for producing a decoded signal indicating the nature of a desired page; memory means for storing a digitalized voice signal representing a prerecorded voice comment, means responsive to said decoded signal for reading out of said memory means a stored digitalized voice signal and thereby playing back the sound of the recorded voice comment; means responsive to said decoded signal for sounding an alert tone; and means coupled to said decoding means for playing back said sounds of the selected recorded voice comments after having sounded said paging alert tone.

11. A radio paging receiver as claimed in claim 10 wherein said memory means contains replaceable and changeable digitized messages, whereby said prerecoded voice comments may be changed.

* * * * *